US007512365B2

(12) United States Patent
Mano et al.

(10) Patent No.: US 7,512,365 B2
(45) Date of Patent: Mar. 31, 2009

(54) TONER SUPPLY DEVICE PROVIDING TONER AGITATION AND DEVELOPING UNIT USING THE SAME

(75) Inventors: Ryosuke Mano, Kashiba (JP); Takahiko Kimura, Ikoma (JP)

(73) Assignee: Sharp Kabushiki Kaisha, Osaka (JP)

( * ) Notice: Subject to any disclaimer, the term of this patent is extended or adjusted under 35 U.S.C. 154(b) by 42 days.

(21) Appl. No.: 11/603,092

(22) Filed: Nov. 22, 2006

(65) Prior Publication Data

US 2007/0122206 A1 May 31, 2007

(30) Foreign Application Priority Data

Nov. 28, 2005 (JP) ..... 2005-341812

(51) Int. Cl.
*G03G 15/08* (2006.01)

(52) U.S. Cl. ..... 399/258

(58) Field of Classification Search ..... 399/252, 399/254–256, 258

See application file for complete search history.

(56) References Cited

U.S. PATENT DOCUMENTS

| | | | | |
|---|---|---|---|---|
| 5,943,538 | A * | 8/1999 | Choi | 399/258 |
| 6,366,755 | B1 * | 4/2002 | Takashima | 399/254 |
| 6,597,882 | B1 * | 7/2003 | Tanaka | 399/258 |
| 6,978,108 | B2 * | 12/2005 | Sakamaki | 399/258 |
| 7,110,707 | B2 * | 9/2006 | Nishitani | 399/258 |
| 7,139,516 | B2 * | 11/2006 | Makino | 399/258 |
| 7,257,353 | B2 * | 8/2007 | Kawai et al. | 399/254 |
| 7,395,015 | B2 * | 7/2008 | Ishiguro et al. | 399/258 |
| 2005/0226656 | A1 * | 10/2005 | Tsuda et al. | 399/258 |
| 2006/0182470 | A1 | 8/2006 | Tamura et al. | |
| 2006/0216067 | A1 * | 9/2006 | Okoshi | 399/258 |
| 2006/0222412 | A1 * | 10/2006 | Ito et al. | 399/258 |

FOREIGN PATENT DOCUMENTS

| | | |
|---|---|---|
| JP | 2002-278236 A | 9/2002 |
| JP | 2003-162143 A | 6/2003 |

OTHER PUBLICATIONS

Office Action mailed Feb. 20, 2008 in corresponding U.S. Appl. No. 11/600,841.

* cited by examiner

*Primary Examiner*—David M Gray
*Assistant Examiner*—Ruth N Labombard
(74) *Attorney, Agent, or Firm*—Nixon & Vanderhye, P.C.

(57) ABSTRACT

A toner supply device for supplying toner to a developing unit includes: a toner cartridge; and a toner feed device having a casing for reserving toner and a toner agitator shaft for agitating and conveying the toner. The toner feed device includes a toner input port for allowing entrance of toner into the casing and a toner feed port for feeding toner to the developing unit, the toner input port and toner feed port being arranged on the outer side of the developing roller with respect to the direction of the developing roller's axis of the developing unit, and the toner agitator shaft conveys and supplies the toner from the toner input port along the direction of the developing roller's axis to the toner feed port.

3 Claims, 5 Drawing Sheets

TONER SUPPLY DEVICE PROVIDING TONER AGITATION AND DEVELOPING UNIT USING THE SAME

This Nonprovisional application claims priority under 35 U.S.C. §119(a) of Patent Application No. 2005-341812 filed in Japan on 28 Nov. 2005, the entire contents of which are hereby incorporated by reference.

BACKGROUND (1) Field of the Invention

The present technology relates to a toner supply device and a developing unit using the above mentioned device, in particular relating to a toner supply device and a developing unit using the above mentioned device for use in an image forming apparatus for performing image formation with toner.

(2) Related Art and Other Considerations

Conventionally, in image forming apparatuses using toner, such as copiers, facsimile machines, etc., a toner supply device such as a toner cartridge etc., is used to supply toner to the developing unit to thereby achieve continuous operation of image output.

There is a generally known method for supplying toner to the developing unit, in which toner stored in a toner cartridge is directly supplied to the developing unit (see patent document 1 (Japanese Patent Application Laid-open 2003-162143).

However, the conventional method of directly supplying toner from the toner cartridge to the developing unit suffers the problem that the fluidity of the supplied toner is prone to vary, consequently causing variation in image quality. Also, in a configuration where toner which has been degraded in fluidity (due to long-term inactivity or the like) is processed into high-fluidity toner so as to be supplied without hindrance, toner beyond a controlled amount may be supplied to the developing unit, causing the problem that the toner concentration in the developer rises, exerting influence on mage quality and color tones.

In particular, in a tandem-type color image forming apparatus that requires high image quality, four image forming process units corresponding to four colors, i.e., YMCK, need to be arranged. And yet the developing units are required to be miniaturized so as to meet the demand for a compact equipment configuration. As a result, miniaturization problem occur for the developing units. That is, it becomes difficult to ensure uniform properties of the toner attributed to fluidity, such as charge quantity, toner concentration and the like, by agitation, and it also becomes difficult to secure the capability of absorbing the variations in supply quantity.

BRIEF SUMMARY

The present technology has been devised in view of the above conventional problems. It is therefore an object of the present technology to provide a toner supply device and a developing unit using the device, which uniformly supplies the toner to the developing unit and which achieves stable toner supply based on toner supply control even when toner of a high fluidity is supplied.

The toner supply device and developing unit according to the present invention for solving the above problem are configured as follows.

In accordance with a first aspect of the present technology, a toner supply device for supplying toner to a developing unit, includes: a toner container for storing toner; and a toner feed device disposed adjacent to the toner container and including a toner reservoir for reserving the toner supplied from the toner container and a toner conveyor for conveying the toner in the toner reservoir while agitating the toner. The toner feed device agitates the toner supplied from the toner container, then feeds the agitated toner to the developing unit. The toner feed device comprises a toner input portion for allowing entrance of toner from the toner container to the toner reservoir and a toner feed portion for feeding toner from the toner reservoir to the developing unit. The toner input portion and toner feed portion are arranged on the outer side of the developing roller with respect to the direction of the developing roller's axis of the developing unit. The toner conveyor conveys and supplies the toner entering from the toner input portion to the toner feed portion along the direction of the developing roller's axis.

In a toner supply device according to a second aspect of the present technology, in addition to the configuration described in the first aspect, the toner conveyor comprises a screw element or a plurality of agitating plates tilted in the toner conveying direction.

In accordance with a third aspect of the present technology, a developing unit having a toner supply device with a toner container for storing toner and supplying toner to the developing unit is characterized in that the toner supply device is a toner supply device having the above first or second aspect.

According to the first aspect of the present technology, since the toner input portion for allowing entrance of toner from the toner container to the toner reservoir and the toner feed portion for feeding toner from the toner reservoir to the developing unit are arranged on the outer side of the developing roller with respect to the direction of the developing roller's axis of the developing unit, it is possible to prevent the transfer belt, its conveying path, paper feeder and paper feed path from being dirtied by the developing units. Specifically, the toner drops into the toner input portion and therearound when the toner container is attached to or detached from the toner feed device, and the toner drops into the toner feeder and therearound when the toner feed device is attached to or detached from the developing unit.

Further, since the toner conveyor is adapted to convey and supply the toner entering from the toner input portion to the toner feed portion, along the direction of the developing roller's axis, the toner in the toner reservoir is agitated by the toner conveyor. Accordingly, it is possible to constantly supply the toner in a uniform condition to the developing unit, and it is also possible to realize stable toner supply based on toner supply control because no toner will directly flow into the developing unit even though the toner having a high enough fluidity is used.

According to the second aspect of the present technology, in addition to the effect obtained from the first aspect of the present technology, since the toner conveyor comprises a screw element or a plurality of agitating plates tilted with the toner conveying direction, it is possible to agitate and convey toner with a simple structure.

Further, according to the third aspect of the present technology, since a developing unit having a toner supply device with a toner container for storing toner and supplying toner to the developing unit is provided with the toner supply device according to the first or second aspect, it possible to agitate the toner in the toner reservoir by the toner conveyor so as to constantly supply the toner in a uniform condition to the developing unit. It is also possible to realize stable toner supply based on toner supply control even with the toner having a high enough fluidity. As a result, stable and high quality images can be realized.

DETAILED DESCRIPTION

Figure 1:
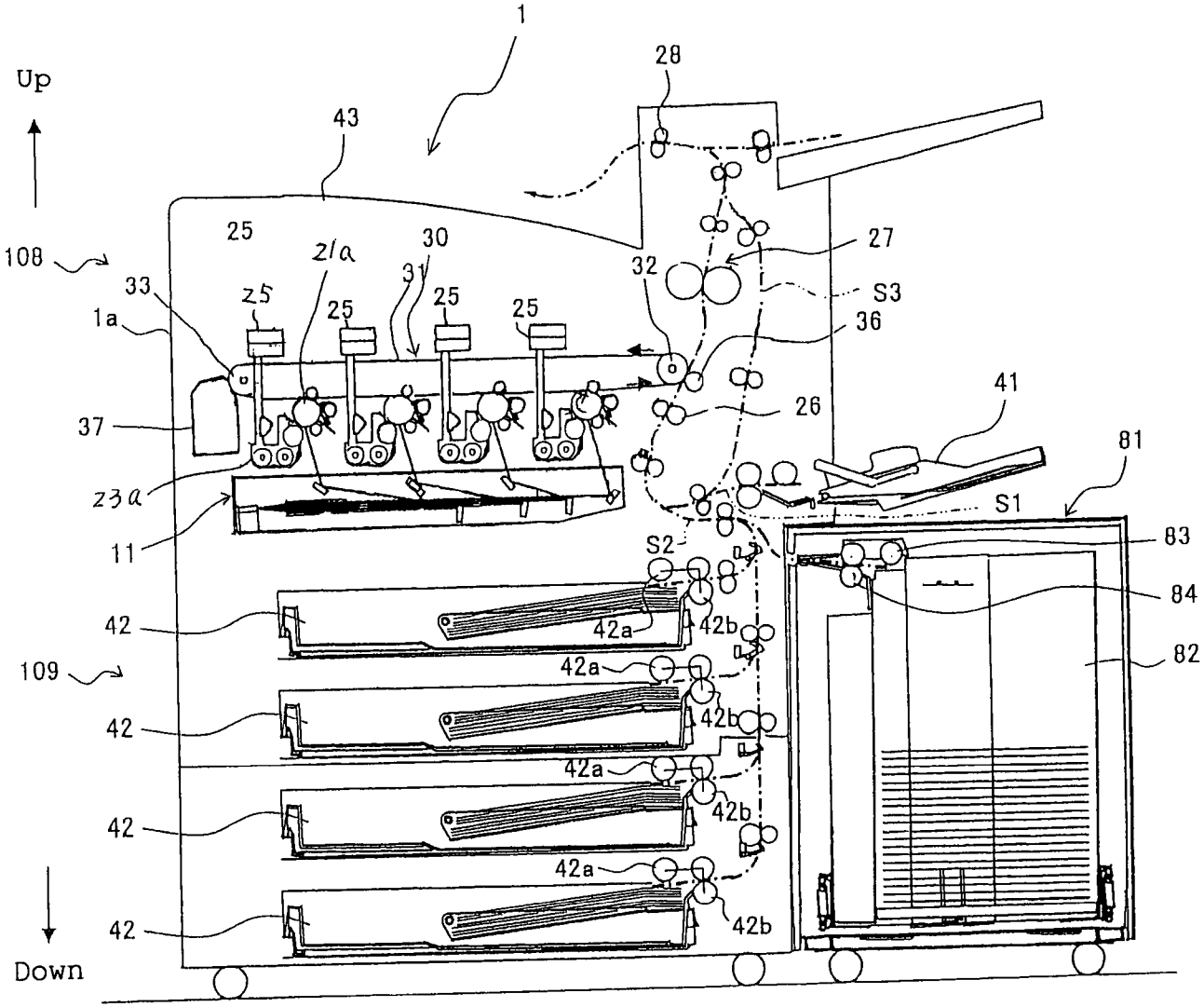
FIG. 1 is an illustrative view showing an overall configuration of an image forming apparatus adopting a developing unit according to an example embodiment.
Figure 2:
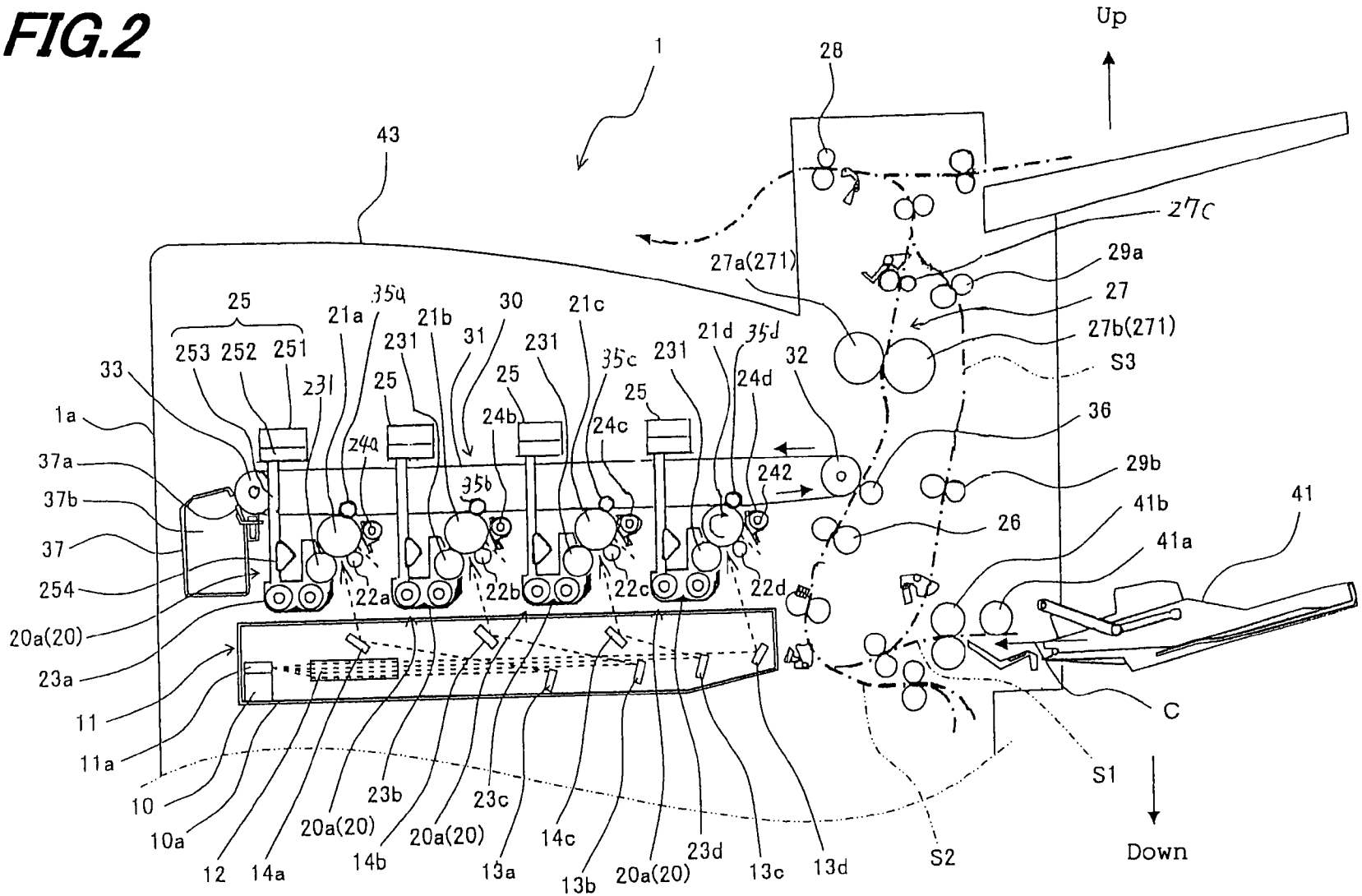
FIG. 2 is a partial detailed view showing a configuration of image forming units for constituting the image forming apparatus.
Figure 3:
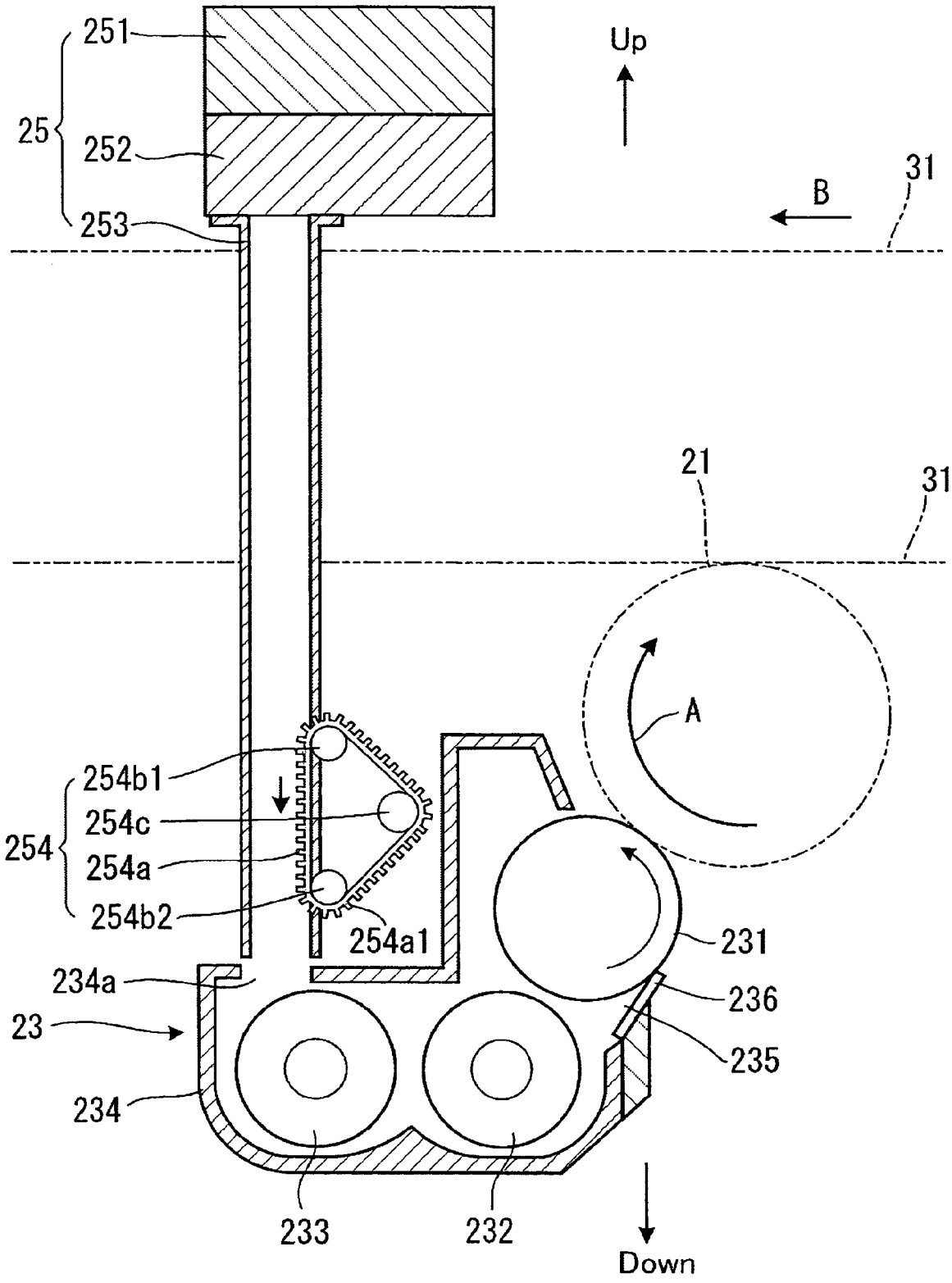
FIG. 3 is a side sectional view showing a configuration of a developing unit and a toner supply device for constituting the image forming apparatus.

FIG. 1 is an illustrative view showing an overall configuration of an image forming apparatus adopting a developing unit according to an example embodiment. FIG. 2 is a partial detailed view showing a configuration of image forming units for constituting the image forming apparatus. FIG. 3 is a side sectional view showing a configuration of a developing unit and a toner supply device for constituting the image forming apparatus.

As shown in FIG. 3, the present embodiment is a developing unit 23 (FIG. 3) for use in an image forming apparatus 1 (FIGS. 1 and 2) in which a developer image formed by the developer supplied from a developing roller 231 to a photoreceptor drum 21 in accordance with image data is transferred to a recording sheet by way of a transfer process. The developing unit 23 has a toner cartridge (toner container) 251 for storing toner and a toner supply device 25 for supplying toner to developing unit 23 so as to enable continuous image output operation by automatic toner supply to the developing unit 23.

As shown in FIGS. 1 and 2, image forming apparatus 1 to which developing unit 23 according to the present embodiment is mounted includes a plurality of process printing units (image forming means) 20 (20*a*, 20*b*, 20*c* and 20*d*).Each process printing unit 20 has a photoreceptor drum 21 (21*a*, 21*b*, 21*c* or 21*d*) [on which a developer image (which will be referred to as "toner image" hereinbelow) is formed with a developer (which will be referred to as "toner" hereinbelow) corresponding to the color of color-separated image information] and a developing unit 23 for supplying the developer to the photoreceptor drum 21 surface. The image forming apparatus 1 further comprises an exposure unit (light scanning device) 10 for creating electrostatic latent images on photoreceptor drums 21 of individual colors by illumination of laser beams in accordance with image information; a transfer belt unit 30 having an endless transfer belt 31 for conveying the fed recording paper; and a fixing unit 27 for thermally fixing the toner image that has been transferred to the recording paper, by means of a heat roller 27*a* and a pressing roller 27*b*.

To begin with, the overall configuration of image forming apparatus 1 will be described.

As shown in FIGS. 1 and 2, image forming apparatus 1 according to the present embodiment is a so-called digital color printer which is adapted to output a color image by separating image information into colors and forming images of individual colors. The image forming apparatus 1 mainly comprises an image forming portion 108 and a paper feed portion 109, and forms multi-color images or monochrome images on recording paper in accordance with a print job sent from an information processor (not illustrated) such as a personal computer etc., externally connected.

Image forming portion 108 forms multi-color images based on electrophotography with yellow (Y), magenta (M), cyan (C) and black (BK) colors. This image forming portion mainly comprises exposure unit 10, process printing units 20, fixing unit 27, a transfer belt unit 30 having transfer belt 31 as a transfer means, transfer roller 36 and a transfer belt cleaning unit 37.

In the overall arrangement of image forming portion 108, fixing unit 27 is disposed on the top at one end side of a housing 1*a* of image forming apparatus 1. Transfer belt unit 30 is extended under the fixing unit 27 from one end side to the other end side of housing 1a.Process printing units 20 are disposed under the transfer belt unit 30. Exposure unit 10 is disposed under the process printing units 20.

Further, transfer belt cleaning unit 37 is arranged on the other end side of transfer belt unit 30. Also, a paper output tray 41 is arranged contiguous to fixing unit 27, over image forming portion 108. Paper feed portion 109 is arranged under the image forming portion 108.

In the present embodiment, four process printing units 20*a*, 20*b*, 20*c* and 20*d*, corresponding to individual colors, i.e., black (BK), yellow (Y), magenta (M) and cyan (C), are arranged as process printing units 20 sequentially in the direction of movement of transfer belt 31.

The process printing unit 20a for the color whose toner image (among all the toner images)is transferred to transfer belt 31 is located at a position most distant from transfer roller 36 and holds a toner of black color so as to form a black toner image first on transfer belt 31.

These process printing units 20*a*, 20*b*, 20*c*and 20*d*are arranged sequentially in the approximately horizontal direction (in the left-to-right direction in the drawing) in housing 1*a*, and include respective photoreceptor drums 2l*a*, 21*b* , 21*c* and 21*d* [as the image support for each individual associated color], respective chargers (charging means) 22*a*, 22*b*, 22*c*and 22*d* [for charging the photoreceptor drums 2l*a*, 21*b*, 2l*c* and 2l*d*], respective developing units (developing means) 23*a*, 23*b*, 23*c*and 23*d*, and respective cleaner units 24*a*, 24*b*, 24*c*and 24*d* as well as other components.

The symbols a, b, c, and d are added to the constituents for individual colors to show correspondence to black (BK), yellow (Y), magenta (M) and cyan (C), respectively. In the description hereinbelow, however, the constituents provided for each color are generally referred to as photoreceptor drum 21, charger 22, developing unit 23, and cleaner unit 24, except in the case where the constituents corresponding to a specific color need to be specified.

Photoreceptor drum 21 is arranged so that part of its outer peripheral surface comes into contact with the surface of transfer belt 31. A charger 22 (which serves as an electric field generator), developing unit 23, and cleaner unit 24 are arranged along, and close to, the outer peripheral surface of the drum 21.

A corona-wire charger is used as charger 22 and is arranged, at a position on the approximately opposite side across photoreceptor drum 21, from transfer belt unit 30 and close to the outer peripheral surface of photoreceptor drum 21. Though in the present embodiment a corona-wire charger is used as charger 22, any type of charger can be used without limitation, in place of the corona-wire charger, such as a fur brush type charger, magnetic brush type charger, roller-type charger, saw-toothed type charger, ion-generation charging device etc., as long as it can provide the desired charge performance to the photoreceptor drum.

Each developing unit 23 (23*a* to 23*d* ) holds an associated toner of black (BK), yellow (Y), magenta (M) or cyan (C) color and is arranged on the downstream side of charger 22 with respect to the rotational direction of the photoreceptor drum (in the direction of arrow A in the drawing).

In developing units 23*a* to 23*d*, developing rollers 231*a* to 231*d* are arranged opposing photoreceptor drums 21*a* to 21*d*, respectively so as to supply the associated colors of toners, respectively, to the electrostatic latent images formed on the outer peripheral surfaces of photoreceptor drums 21*a* to 21*d* and visualize them.

Cleaner unit 24 is arranged on the upstream side of charger 22 with respect to the rotational direction of the photoreceptor drum. Cleaner unit 24 has a cleaning blade and is configured so that the front end of the cleaning blade is positioned in abutment with the outer peripheral surface of photoreceptor 21 so as to scrape and collect the leftover toner off the photoreceptor drum 21. A reference numeral 242 in the drawing designates a conveying screw for conveying the collected toner.

In the present embodiment, a cleaning blade is used but the cleaning unit is not limited to this configuration. One or more cleaning blades may be used or a fur-brush or magnetic brush may be used alone. Alternatively, a fur-brush or magnetic brush may be used in combination with a cleaning blade. That is, any configuration may be used as long as it can scrape and collect the leftover toner off the photoreceptor drum 21.

Exposure unit 10 (FIG. 2) mainly a box-shaped housing 10*a*, a laser scanning unit (LSU) 11 (having a laser illuminator 11*a* incorporated in the housing 10*a*), an f-θ lens 12, and reflection mirrors 13*a*, 13*b*, 13*c*, 13*d*, 14*a*, 14*b* and 14*c* (for reflecting the laser beams for associated colors).

The laser beam emitted from the laser illuminator of laser scanning unit 11 is separated into components of different colors, by an unillustrated polygon mirror and f-θ lens 12, then the separated components of light are reflected by respective reflection mirrors 13*a* to 13*d* and 14*a* to 14*c* to illuminate the respective photoreceptor drums 21*a*, 21*b*, 21*c* and 21*d* of individual colors.

Concerning laser scanning unit 11, a writing head comprising an array of light emitting devices such as EL (electro luminescence), LED (light emitting diode) and others, may be used instead of the laser illuminator. Also, a light source in combination with a liquid crystal shutter may be used. That is, any configuration can be used as long as it can create an electrostatic latent image on the photoreceptor drum 21 surface.

As shown in FIG. 1, transfer belt unit 30 essentially comprises transfer belt 31, a transfer belt drive roller 32, a transfer belt driven roller 33, and intermediate transfer rollers 35*a*, 35*b*, 35*c* and 35*d*.

In the following description, any of the intermediate transfer rollers 35*a*, 35*b*, 35*c* and 35*d* will be referred to as intermediate transfer roller 35 when general mention is made.

Transfer belt 31 comprises an endless film of about 75 μm to 120 μm thick. Transfer belt 31 is essentially made from polyimide, polycarbonate, thermoplastic elastomer alloy or the like.

Also, transfer belt 31 is tensioned by transfer belt drive roller 32, transfer belt driven roller 33 and intermediate transfer rollers 35 so that its surface comes into contact with the outer peripheral surfaces of photoreceptor drums 21. Transfer belt 31 is adapted to move in the auxiliary scan direction (in the direction of arrow B in the drawing) by the driving force of the transfer belt drive roller 32.

Transfer belt drive roller 32 is disposed at one end side of housing la and drives the transfer belt 31 by applying a driving force to transfer belt 31 whilst nipping and pressing the transfer belt 31 and a recording sheet together between itself and transfer roller 36 to convey the recording sheet.

Transfer belt driven roller 33 is disposed on the other end side of housing 1*a*, so as to suspend and tension the transfer belt 31 approximately horizontally from the fixing unit 27 side to the other end side of housing 1*a*, in cooperation with transfer belt drive roller 32. However, if the dimension in the width direction of image forming apparatus 1 in FIG. 1 needs to be smaller, that is, if the footprint is made smaller with respect to the width direction in order to achieve space-saving, the position of transfer belt drive roller 32 may be displaced so that transfer belt 31 is inclined either way from the fixing unit 27 side to the other of housing 1*a* while the photoreceptors, developing units, laser illuminator, fixing unit and other components may be rearranged and resized as appropriate in association with that change in layout.

Intermediate transfer rollers 35 are arranged in the interior space of transfer belt 31 wound between transfer belt drive roller 32 and transfer belt driven roller 33 and positioned with their axes displaced relative to respective photoreceptor drums 21, in the lateral direction in the drawing, to the downstream side with respect to the moving direction of transfer belt 31, so as to press the inner surface of transfer belt 31 and bring its outer peripheral surface into contact with part of the outer peripheral surface of each photoreceptor drum 21, so that a predetermined amount of nip may be formed.

Further, intermediate transfer roller 35 is formed of a metal (e.g., stainless steel) shaft having a diameter of 8 to 10 mm and a conductive elastic material such as EPDM, foamed urethane etc., coated on the outer peripheral surface of the metal shaft. However, the configuration should not be limited to use of these elastic materials.

The thus formed intermediate transfer roller 35 is applied with a high-voltage transfer bias for transferring the toner image formed on photoreceptor drum 21 to transfer belt 31, i.e., a high voltage of a polarity (+) opposite to the polarity (−) of the electrostatic charge on the toner, so as to apply a uniform high voltage from the elastic material to transfer belt 31.

The visualized toner images (electrostatic images) formed on the photoreceptor drums 21 correspondingly to respective colors are transferred one over the other on transfer belt 31, reproducing the image information that has been input to the apparatus. The thus formed laminated image information is transferred to the recording sheet by transfer roller 36 disposed at its contact point with transfer belt 31.

Transfer roller 36 as a constituent of the transfer means is one that transfers the developer image transferred to transfer belt 31 to recording paper, and is arranged opposing transfer belt drive roller 32 at approximately the same level and in parallel thereto and pressing against the transfer belt 31 wound on the transfer belt driver roller 32, forming a predetermined nip therewith while being applied with a high voltage of a polarity (+) opposite to the polarity (−) of the static charge on the toner, for transferring the multi-color toner image formed on the transfer belt 31 to the recording paper.

In order to produce a constant nip between transfer belt 31 and transfer roller 36, either transfer belt drive roller 32 or transfer roller 36 comprises a hard material such as metal or the like while the other roller is formed of a soft material such as elastic rubber, foamed resin, etc.

A registration roller 26 is provided under transfer belt drive roller 32 and transfer roller 36. This registration roller 26 is configured so as to deliver the sheet toward the transfer roller 36 side by aligning the front end of a recording sheet fed from paper feed portion 109 with the leading end of the toner image on transfer belt 31.

Since the toner adhering to transfer belt 31 as the belt comes in contact with photoreceptor drums 21, or the toner remaining on the transfer belt 31 which has not been transferred to the recording sheet by transfer roller 36, would cause contamination of color toners at the next operation, such toner is adapted to be removed and collected by transfer belt cleaning unit 37.

Transfer belt cleaning unit 37 includes: a cleaning blade 37*a*, located near transfer belt driven roller 33 and arranged so as to abut (come into sliding contact with) transfer belt 31; and a box-like toner collector 37*b* for temporarily holding the waste toner, left over on, and scraped from, transfer belt 31 by the cleaning blade 37*a*, to thereby scrape and collect the leftover toner off the transfer belt 31 surface.

Also, transfer belt cleaning unit 37 is arranged near process printing unit 20*a*, on the upstream side of the process printing unit 20*a* with respect to the direction of movement of transfer belt 31. Further, transfer belt 31 is supported from its interior side by transfer belt driven roller 33, at the portion where cleaning blade 37*a* comes into contact with the outer surface of transfer belt 31.

Fixing unit 27 includes: as shown in FIG. 1, a pair of fixing rollers 271 consisting of a heat roller 27*a* and pressing roller 27*b*; and a conveying roller 27*c* above the fixing rollers 271. A recording sheet is input from below fixing rollers 271 and output to above conveying roller 27*c*.

Above fixing unit 27, a paper discharge roller 28 is arranged so that the recording sheet conveyed from conveying roller 27*c* is discharged by the paper discharge roller 28 to paper output tray 43.

Referring to the fixing of a toner image by fixing unit 27, a heating device (not shown) such as a heater lamp or the like, provided inside or close to heat roller 27*a* is controlled based on the detected value from a temperature detector (not shown) so as to keep heat roller 27*a* at a predetermined temperature (fixing temperature) while the recording sheet with a toner image transferred thereon is heated and pressed between heat roller 27*a* and pressing roller 27*b* as it is being conveyed and rolled thereby, so that the toner image is thermally fused onto the recording sheet.

A duplex printing paper path S3 for double-sided printing is constructed adjacent to fixing unit 27, from the rear side of fixing unit 27 downward, with respect to the direction of conveyance, to the vicinity of paper feed portion 109 (FIG. 1). Conveying rollers 29*a* and 29*b* are arranged at the top and bottom and along the duplex printing paper path S3, thereby the recording sheet is inverted and delivered again toward transfer roller 36.

Specifically, conveying roller 29*a* is disposed at the rear of fixing unit 27 and conveying roller 29*b* is located below conveying roller 29*a* with respect to the top and bottom direction and at approximately the same level as registration roller 26.

In the present embodiment, heat roller 27*a* using a heating means made up of a heater lamp etc., is used with pressing roller 27*b*, but an induction heating type heating means may be used alone or in combination. Further, it is not necessary to use a roller-formed structure as a means for applying pressure. That is, any appropriate method can be used as long as it can uniformly fix the toner image with heat without causing any image disturbance.

Paper feed portion 109 (FIG. 1) includes a manual feed tray 41, a plurality of paper feed cassettes 42 and a large-volume paper feed cassette 81 for holding recording paper to be used for image forming, and is adapted to deliver recording paper, sheet by sheet, from manual feed tray 41, any of paper feed cassettes 42 or large-volume paper feed cassette 81 to image forming portion 108.

As shown in FIGS. 1 and 2, manual feed tray 41 is arranged at one side end (on the right side in the drawing) of housing 1*a* of image forming apparatus 1 so that it can be unfolded outside when used and folded up to the one end side when unused. This tray delivers paper, sheet by sheet, into the housing 1*a* of image forming apparatus 1 when the user places a few recording sheets (necessary number of sheets) of a desired type.

Arranged on the downstream side with respect to the paper feed direction (the direction of arrow C in the drawing) of recording paper by manual feed tray 41, inside housing 1*a* of image forming apparatus 1, is a pickup roller 41*a* at the side of exposure unit 10. A conveying roller 41*b* is also disposed at approximately the same level further downstream with respect to the paper feed direction.

Pickup roller 41*a* touches one edge part of the surface of the recording sheet that is fed from manual feed tray 41 and reliably conveys the paper, sheet by sheet, by the function of the roller's frictional resistance.

The aforementioned pickup roller 41*a* and conveying roller 41*b* constitute a recording paper conveying path S1.

A multiple number of paper feed cassettes 42 are arranged under the image forming portion 108 and exposure unit 10 in housing 1*a*, so as to accommodate a large amount of recording sheets of sizes specified by the specification of the apparatus or of sizes that are determined beforehand by the user. In this example embodiment, four kinds of recording paper can be accommodated.

Arranged above one end side (the left-hand side in the drawing) of each paper feed cassette 42 is a pickup roller 42*a*. A conveying roller 42*b* is also provided downstream of the pickup roller 42*a* with respect to the recording paper's direction of conveyance.

Pickup roller 42*a* touches one edge part of the surface of the topmost sheet of recording paper set on the paper feed cassette 42 corresponding to a printout request and reliably picks up and feeds the paper, sheet by sheet, by the function of roller's frictional resistance.

Conveying roller 42*b* conveys the recording sheet delivered from pickup roller 42*a* upward along a recording sheet feed path S2 formed on one end side inside housing 1*a* to image forming portion 108.

Large-volume paper feed cassette 81 is arranged at the side of the image forming apparatus, detailedly, at the side where recording sheet feed path S2 for paper feed cassettes 42 is laid out. Inside this large-volume paper feed cassette 81, a large-volume paper feeder 82 for storing a large amount of recording paper is provided, over which a pickup roller 83 is provided at a position corresponding to one edge part of the surface of the topmost sheet of the recording paper set thereon. A conveying roller 84 is arranged on the downstream side of the pickup roller 83 with respect to the recording paper' direction of conveyance.

Conveying roller 84 conveys the recording paper delivered from pickup roller 83 toward recording sheet feed path S2 in housing 1*a* from the side of the image forming apparatus.

Next, image output by image forming apparatus 1 of the present embodiment will be described.

Image forming apparatus 1 is constructed so as to transfer the toner images formed on photoreceptor drums 21 to a recording sheet fed from paper feed portion 109 by a so-called intermediate transfer process (offset process) via transfer belt 31.

First, charger 22 uniformly electrifies the outer peripheral surface of photoreceptor drum 21 at a predetermined voltage.

Each electrified photoreceptor drum 21 is irradiated with a laser beam from exposure unit 10, so that an electrostatic latent image for each color is formed on the photoreceptor drum 21 for the color.

Then, toner is supplied from developing units 23*a* to 23*d* to the outer peripheral surfaces of photoreceptor drums 21*a* to 21*d* so that the static latent images formed on the outer peripheral surfaces of photoreceptor drums 21 are visualized with toner so as to form toner images.

The toner image formed on photoreceptor drum 21 is transferred to transfer belt 31.

Transfer of the toner image from photoreceptor drum 21 to transfer belt 31 is done by application of a high voltage from intermediate transfer roller 35 arranged in contact with the interior side of transfer belt 31.

As intermediate transfer roller 35 is applied with a high voltage of a polarity (+) opposite to that of the polarity (−) of the electrostatic charge on the toner, transfer belt 31 has a high potential uniformly applied by the intermediate transfer roller 35, presenting the opposite polarity (+). Thereby, the toner image bearing negative (−) charge on photoreceptor drum 21 is transferred to transfer belt 31 as the photoreceptor drum 21 turns and comes into contact with transfer belt 31.

The colored toner images formed on respective photoreceptor drums 21 are transferred to, and laid on, transfer belt 31 one over another, in the order of black (BK), yellow (Y), magenta (M) and cyan (C) as transfer belt 31 moves to come into contact with each of the rotating photoreceptor drums 21, forming a color toner image on transfer belt 31.

In this way, the toner images developed from static latent images on photoreceptor drums 21 for every color, are laminated on transfer belt 31 so that the image for printing is reproduced as a multi-color toner image on transfer belt 31.

Then, as transfer belt 31 moves and reaches the position where the recording sheet and the transfer belt 31 meet, the multi-color toner image having been transferred on transfer belt 31 is transferred from transfer belt 31 to the recording sheet by the function of transfer roller 36.

Since the toner adhering to transfer belt 31 as the belt comes in contact with photoreceptor drums 21, or the toner remaining on transfer belt 31 which has not been transferred to the recording sheet by the function of transfer roller 36, would cause contamination of color toners at the next operation, it is removed and collected by transfer belt cleaning unit 37.

Next, the operation of feeding recording sheets by paper feed portion 109 (FIG. 1) will be described.

When the recording paper placed on manual feed tray 41 is used, as shown in FIG. 1 the paper is taken in by pickup roller 41*a* from manual feed tray 41, sheet by sheet, at controlled timings in accordance with the instructions from a control panel (not shown), and fed into the machine.

The recording sheet thus taken into the machine is conveyed along recording paper feed path S1 by conveying roller 41*b* to image forming portion 108.

When the recording paper accommodated in paper feed cassettes 42 is used, the paper is separated and fed from paper feed cassette 42, sheet by sheet, by the corresponding pickup roller 42*a* in accordance with a printout request and conveyed by conveying roller 42*b* along recording paper feed path S2 to image forming portion 108.

When the recording paper accommodated in large-volume paper feed cassette 81 is used, recording paper is separated and fed from large-volume paper feeder 82, sheet by sheet, by the pickup roller 83 in accordance with a printout request and conveyed by conveying roller 84 along recording paper feed path S2 to image forming portion 108.

The recording sheet conveyed from manual feed tray 41, paper feed cassette 42 or large-volume paper feed cassette 81 is delivered to the transfer roller 36 side, by registration roller 26, at such a timing as to bring the front end of the recording sheet in register with the leading end of the toner image on transfer belt 31, so that the toner image on transfer belt 31 is transferred to the recording sheet.

The recording sheet with a toner image transferred thereon is conveyed approximately vertically and reaches fixing unit 27, where the toner image is thermally fixed to the recording sheet by heat roller 27*a* and pressing roller 27*b*.

When one-sided printing is selected, the recording sheet having passed through fixing unit 27 is discharged by discharge rollers 28 and placed face down on paper output tray 43.

In contrast, when double-sided printing is selected, the recording sheet is stopped and nipped at paper discharge roller 28, then the paper discharge roller 28 is rotated in reverse so that the recording sheet is guided to duplex printing paper path S3 and conveyed again to registration roller 26 by conveying rollers 29*a* and 29*b*.

By this movement, the printing face of the recording sheet is inverted and the direction of conveyance is reversed.

Illustratively, the leading edge of the sheet at the first printing is directed to the trailing end when the underside is printed, or the trailing edge of the sheet at the first printing is directed to the leading side when the underside is printed.

After the toner image is transferred and thermally fixed to the underside of the recording sheet, the sheet is discharged to paper output tray 43 by paper discharge roller 28.

Thus, the transfer operation to recording paper is performed.

Next, the configuration of developing unit 23 and toner supply device 25 according to the present embodiment will be described in detail with reference to FIGS. 3 to 6.

Figure 4:
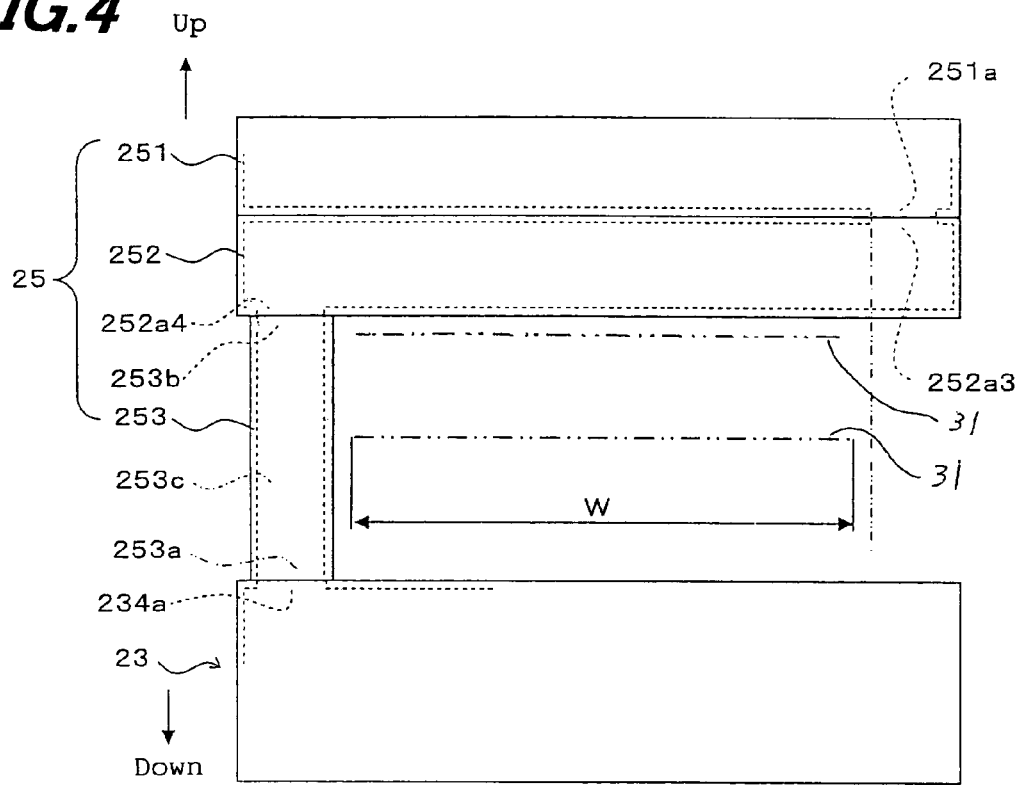
FIG. 4 is an overall front view showing the developing unit and toner supply device.
Figure 5:
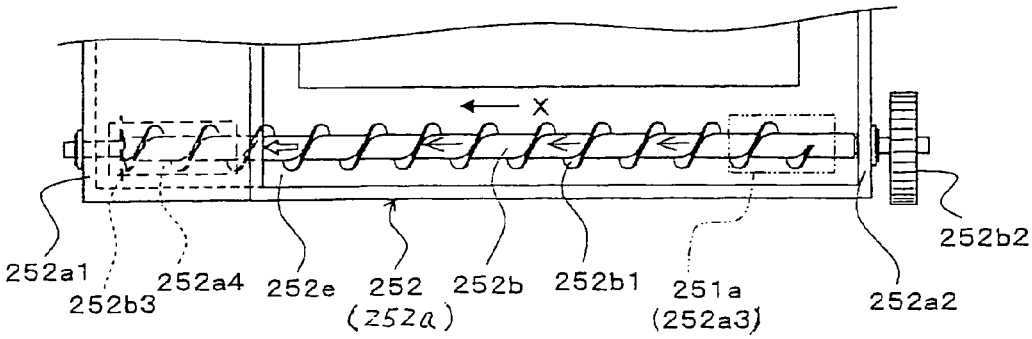
FIG. 5 is a plan view showing a configuration of a toner feed device for constituting the toner supply device.
Figure 6:
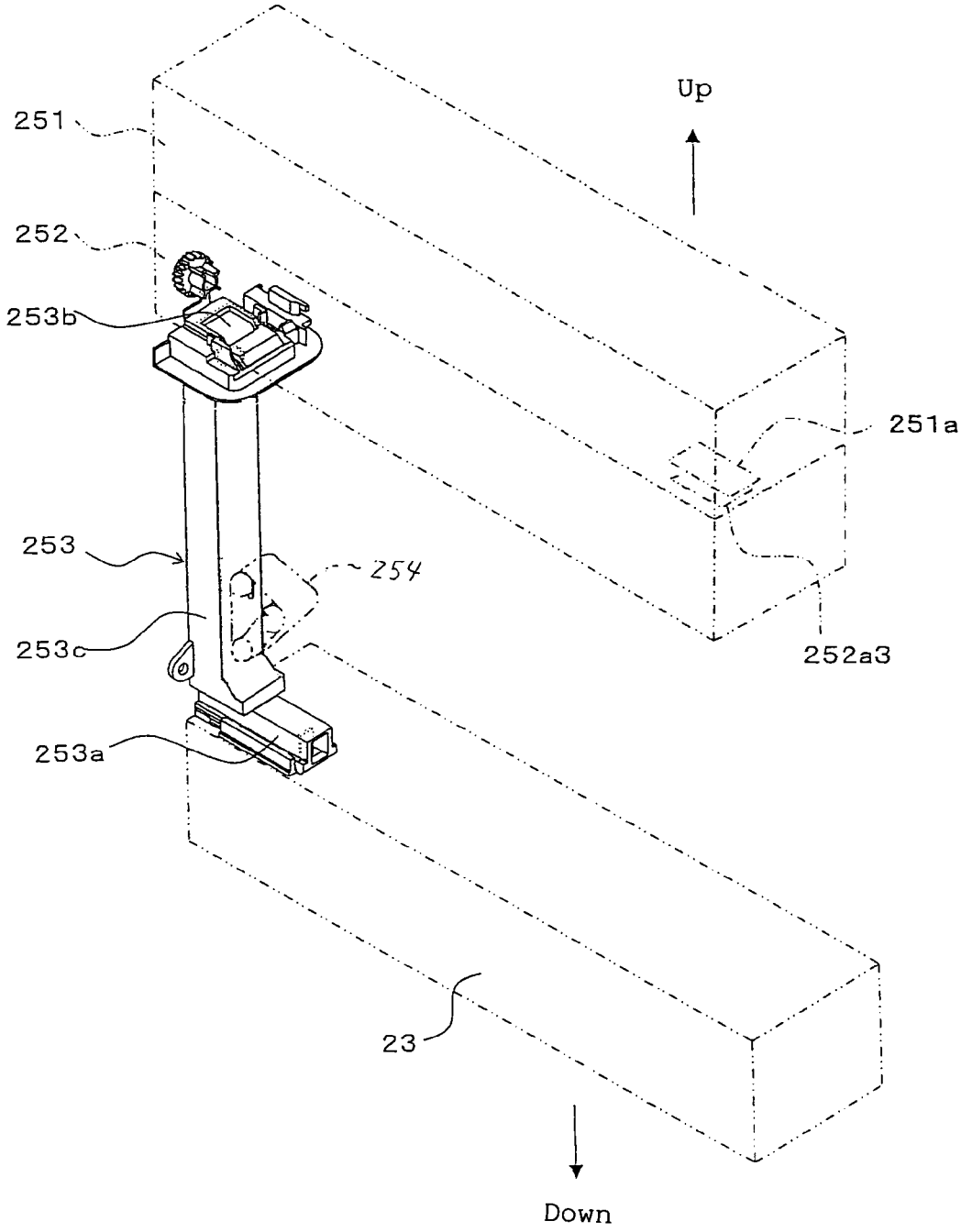
FIG. 6 is an illustrative view showing a configuration of a toner input passage part for coupling the toner feed device and the developing unit.

FIG. 4 is an overall front view showing a configuration of the developing unit and toner supply device, FIG. 5 is a plan view showing a configuration of a toner feed device as a constituent of the toner supply device; and FIG. 6 is an illustrative view showing the configuration of a toner input passage part for coupling the toner feed device and the developing unit.

As shown in FIG. 3, developing unit 23 has a casing 234 that forms its exterior, in which a developing roller 231, a first toner conveying roller 232 and a second toner conveying roller 233 are arranged, and is mounted to the image forming apparatus body with the developing roller 231 opposed in abutment with, or close to, photoreceptor drum 21.

First toner conveying roller 232 and second toner conveying roller 233 are disposed in the bottom of casing 234 in parallel with each other along the direction of axis (axial line) of developing roller 231 (to be referred to merely as the axis direction) so that the toner that is fed into casing 234 is agitated with the developer and conveyed to developing roller 231.

Developing roller 231 is arranged over and above first toner conveying roller 232 so as to be exposed from an aftermentioned opening mouth 235.

First toner conveying roller 232 and second toner conveying roller 233 and developing roller 231 are formed with approximately the same length as photoreceptor drum 21.

Casing 234 is a box-shaped configuration elongated in the axis direction of developing roller 231 when it is mounted in the image forming apparatus body, and formed with an opening, i.e., opening mouth 235 so that developing roller 231 therein opposes photoreceptor drum 21 when developing unit 23 is mounted to the image forming apparatus body.

Opening mouth 235 is made open across the width of casing 234 along the axis direction of developing roller 231 so that at least developing roller 231 will be able to oppose and abut photoreceptor drum 21.

Provided along the bottom edge of opening mouth 235 in the drawing is a blade 236 that extends in the axis direction of developing roller 231. Blade 236 is positioned so as to create a predetermined clearance between the blade 236 edge and the developing roller 231 surface, whereby a predetermined amount of toner can be supplied to the developing roller 231 surface through the clearance.

Arranged over the thus constructed developing unit 23 is toner supply device 25.

Toner supply device 25 essentially comprises, as shown in FIGS. 3 and 4, a toner cartridge (toner container) 251, a toner feed device 252, a toner input passage part 253.

As shown in FIG. 4, toner cartridge 251 has a box-shaped configuration elongated in the width direction of transfer belt 31 (the direction perpendicular to the transfer belt's direction of movement) or in the axis direction of photoreceptor drum 21 or developing roller 231, and supplies toner to toner feed device 252 arranged therebeneath.

As shown in FIG. 4, toner supply from toner cartridge 251 to toner feed device 252 is carried out by feeding toner into toner feed device 252 from a toner supply port 251*a* that is formed at a position further outside, or preferably at a position near the outside of, the positions where transfer belt 31, photoreceptor drum 21 and developing roller 231 are mounted, with respect to the direction of width W of transfer belt 31 or the axis direction of photoreceptor drum 21 or developing roller 231.

As shown in FIG. 5, toner feed device 252 has a box-shaped casing 252*a* elongated in the axis direction of developing roller 231 and in the casing 252*a*, a toner agitator shaft (toner conveyor) 252*b* is arranged parallel to the axis direction of developing roller 231.

Toner agitator shaft 252*b* has a screw 252*b*1 which is extended from a first end side 252*a*1 to a second end side 252*a*2 of toner feed device 252 to agitate and convey toner from the second end side to the first. This agitator shaft 252*b* is adapted to be driven by an unillustrated drive motor by way of a drive gear 252*b*2 arranged on the second end side 252*a*2 of casing 252*a*.

Toner support plate 252*b*3 is provided for toner agitator shaft 252*b* at its downstream side end with respect to the toner's direction of conveyance so as to receive the toner being conveyed.

In the present embodiment, toner agitator shaft 252*b* is formed longer than the width W of transfer belt 31.

The toner agitating means should not be limited to screw 252*b*1, but it may be a structure in which a multiple number of agitating vanes tilted in the toner's direction of conveyance are formed on the toner agitator shaft 252*b*, for example. Any other configuration can also be used as long as it can achieve the same effect.

On the second end side 252*a*2 of casing 252*a*, a toner input port (toner input portion) 252*a*3 for receiving toner supply from toner cartridge 251 arranged on the top thereof is formed. The opening of toner input port 252*a*3 is formed outside the paper feed width at a position opposing part of toner agitator shaft 252*b* for agitating and conveying toner from second end side 252*a*2 to first end side 252*a*1 of casing 252*a*.

Also, a toner feed port (toner feed portion) 252*a*4 for delivering the toner from casing 252*a* to toner input passage part 253 that feeds toner to developing unit 23 is formed on the first end side 252*a*1 of casing 252*a*. The opening of toner feed port 252*a*4 is formed outside (preferably at a position near the outside of) the paper feed width and at a position opposing part of toner agitator shaft 252*b* on the first end side 252*a*1 of casing 252*a*.

Toner input passage part 253 is formed so that its top is integrated with toner feed device 252 and a developing unit attachment portion 253*a* for detachable attachment to developing unit 23 is provided at the bottom thereof, as shown in FIG. 6.

An opening of a toner input port (toner input portion) 253*b* for toner input is formed at the top of toner input passage part 253, and a toner passage 253*c* for toner to pass from this toner input port 253*b* to developing unit attachment portion 253*a* is provided approximately linearly from top to bottom.

Provided for toner passage 253*c* is a toner forwarding device 254 along the toner falling path. Toner forwarding device 254 essentially comprises, as shown in FIGS. 3 and 6, a toner conveyor belt 254*a* for advancing toner downwards, idle rollers 254*b*1 and 254*b*2 for vertically supporting and tensioning the toner conveyor belt 254*a* and a drive roller 254*c*.

A plurality of ribs 254*a*1, each projectively extended across the belt width, are formed lengthwise on the outer surface of toner conveyor belt 254*a*. These ribs 254*a*1 are provided so as to advance the falling toner without it stagnating on the inner wall of toner passage 253*c*.

Drive roller 254*c* applies a drive force to toner conveyor belt 254*a* so that the belt moves downwards in the drawing. This belt drive may be continuously activated while developing unit 23 is in operation or may be controlled so as to be active as appropriate in accordance with the degree of reduction of the amount of toner in developing unit 23.

An opening of a toner input port 234*a* is formed on the top of developing unit 23 at a position corresponding to developing unit attachment portion 253*a*, so that the toner fed through toner passage 253*c* is input into developing unit 23 through developing unit attachment portion 253*a*.

Toner input port 234*a* of developing unit 23 is formed on the same side as that of toner feed port 252*a*4 of toner feed device 252, at a position further outside, or preferably at a position near the outside of, the positions where photoreceptor drum 21 and developing roller 231 are disposed, with respect to the axis direction (longitudinal direction) of photoreceptor drum 21 or developing roller 231.

Next, the operation of toner supply device 25 of the present embodiment will be described.

Toner supply to developing unit 23 by toner supply device 25 is carried out by forwarding toner from toner cartridge 251 to developing unit 23 by way of toner feed device 252 and toner input passage part 253.

As shown in FIG. 5, toner from toner cartridge 251 passes through toner supply port 251*a* and toner input port 252*a*3 of toner feed device 252, and is conveyed from second end side 252*a*2 to first end side 252*a*1 of casing 252*a* or in the direction of arrow X, by toner agitator shaft 252*b* while being agitated in accordance with the predetermined control. Then the toner is supplied from toner feed port 252*a*4 to developing unit 23 by way of the toner input passage part 253.

As shown in FIG. 4, toner supply from toner input passage part 253 to developing unit 23 is carried out by feeding toner into developing unit 23 from a position further outside (or preferably at a position near the outside of) the positions where transfer belt 31, photoreceptor drum 21 and developing roller 231 are mounted, with respect to the direction of width W of transfer belt 31 or the axis direction of photoreceptor drum 21 or developing roller 231.

In this way, in developing unit 23, toner can be supplied as appropriate and as required by toner supply device 25, so that it is possible to stably perform continuous operation without shortage of toner.

When toner in toner cartridge 251 has been consumed and has run short (reduced), developing unit attachment portion 253*a* is disconnected from developing unit 23 while toner cartridge 251, toner feed device 252 and toner input passage part 253 are in the state of being integrated, so that toner is supplied to toner supply device 25 under the condition in which developing unit 23 and toner supply device 25 are separated from each other.

Supplying toner to toner supply device 25 may be performed easily by re-supplying toner into toner cartridge 251 or by replacing the used toner cartridge with a new cartridge full of toner.

According to the present embodiment thus constructed as described above, since toner supply device 25 is constructed with toner feed device 252 so that the toner supplied from toner cartridge 251 can be fed to developing unit 23 after it is agitated, it is possible to constantly supply toner that is uniform to the developing unit, hence it is possible to perform stable toner supply based on toner supply control even with toner having a high enough fluidity.

Since the present embodiment is constructed such that supplying toner from toner input passage part 253 to developing unit 23 is effected using a structure that is located outside developing roller 231 with respect to its axis direction or at a position outside (at a position near the outer side of) the width W of transfer belt, it is possible to perform toner supply without smudging transfer belt 31.

Further, according to the present embodiment, since toner supply device 25 and developing unit 23 are constructed so that they can be separated from each other by use of developing unit attachment portion 253*a* provided for toner input passage part 253, this configuration facilitates maintenance of toner supply device 25 and toner supply even if toner in toner cartridge 251 is running out.

In the present embodiment toner supply device 25 and developing unit 23 are decoupled from each other at toner input passage part 253 as described above, however the coupling mechanism between toner supply device 25 and developing unit 23 of the present invention should not be limited to this. For example, depending on the configuration of image forming apparatus 1, it is possible to provide a configuration in which toner cartridge 251 and toner feed device 252 are separated or in which toner feed device 252 and toner input passage part 253 are separated. That is, the configuration of toner supply device 25 may be developed into any possible form.

In the present embodiment, since toner input passage part 253 is provided as a constituent of toner supply device 25, it is possible to set up the position for supplying toner into developing unit 23 as appropriate. Further, provision of toner forwarding device 254 for toner input passage part 253 makes stable toner supply into developing unit 23 possible without causing any stagnation of toner fed from toner feed device 252 inside toner input passage part 253.

The configuration of toner forwarding device 254 is not limited to that shown in the embodiment, and any configuration may be adopted as long as it can prevent toner from stagnating inside toner input passage part 253.

Though the image forming apparatus 1 of the present embodiment is constructed such that the toner images formed on photoreceptor drums 21 are transferred to transfer belt 31 first and then transferred again to recording paper, it is also possible to apply the present invention to an image forming apparatus of a type that the toner images formed on photoreceptor drums 21 are directly transferred to the recording paper being conveyed by a conveyor belt. Also in this case, needless to say, the same operation and effect can be obtained.

As described heretofore, the configuration of the toner supply device and the developing unit using the same in accordance with the present invention is not limited to the above embodiment, and various changes and modifications may be added without departing from the scope of the present invention.

What is claimed is:

1. A toner supply device for supplying toner to a developing unit, the developing unit comprising a developing roller having a developing roller axis, the developing roller being proximate a photoreceptor drum which, in turn, is proximate a transfer belt, the toner supply device comprising:

a toner container configured to store toner; and a toner feed device disposed adjacent to the toner container and including a toner reservoir configured to hold the toner supplied from the toner container and a toner conveyor configured to convey the toner in the toner reservoir while agitating the toner, wherein the toner feed device is configured to agitate the toner supplied from the toner container, then to feed the agitated toner to the developing unit;

wherein the toner feed device comprises a toner input portion for allowing entrance of toner from the toner container to the toner reservoir and a toner feed portion configured to feed toner from the toner reservoir to the developing unit, the toner input portion and toner feed portion being arranged on an outer side of the developing roller with respect to a direction of the developing roller axis;

wherein the toner conveyor is configured to convey and supply the toner entering from the toner input portion to the toner feed portion, along the direction of the developing roller axis;

wherein the toner feed device and the developing unit are connected by a toner input passage part, wherein the toner input passage part is provided with a toner passage formed approximately linearly and configured whereby toner is supplied from the toner input passage part to the developing unit at a position, relative to the developing roller axis, which is outside a width of the transfer belt; and wherein said toner passage is provided with rollers to advance the toner.

2. A developing unit configured for use in combination with a toner supply device configured to supply toner to a developing unit, the developing unit comprising a developing roller having a developing roller axis, the developing roller being proximate a photoreceptor drum which, in turn, is proximate a transfer belt;

the toner supply device comprising:

a toner container configured to store toner; and a toner feed device disposed adjacent to the toner container and including a toner reservoir configured to hold the toner supplied from the toner container and a toner conveyor configured to convey the toner in the toner reservoir while agitating the toner, wherein the toner feed device is configured to agitate the toner supplied from the toner container, then to feed the agitated toner to the developing unit;

wherein the toner feed device comprises a toner input portion for allowing entrance of toner from the toner container to the toner reservoir and a toner feed portion configured to feed toner from the toner reservoir to the developing unit, the toner input portion and toner feed portion being arranged on an outer side of the developing roller with respect to a direction of the developing roller axis;

wherein the toner conveyor is configured to convey and supply the toner entering from the toner input portion to the toner feed portion, along the direction of the developing roller axis;

wherein the toner feed device and the developing unit are connected by a toner input passage part, wherein the toner input passage part is provided with a toner passage formed approximately linearly and configured whereby toner is supplied from the toiler input passage part to the developing unit at a position, relative to the developing roller axis, which is outside a width of the transfer belt; and wherein said toner passage is provided with rollers to advance the toner.

3. A developing unit configured for use in combination with the toner supply device configured to supply toner to a developing unit;

the developing unit comprising a developing roller having a developing roller axis, the developing roller being proximate a photoreceptor drum which, in turn, is proximate a transfer belt;

the toner supply device comprising:

a toner container configured to store toner; and a toner feed device disposed adjacent to the toner container and including a toner reservoir configured to hold the toner supplied from the toner container and a toner conveyor configured to convey the toner the toner reservoir while agitating the toner, wherein the toner feed device is configured to agitate the toner supplied from the toner container, then to feed tile agitated toner to the developing unit;

wherein the toner feed device comprises a toner input portion for allowing entrance of toner from the toner container to the toner reservoir and a toner feed portion configured to feed toner from the toner reservoir to the developing unit, the toner input portion and toner feed portion being arranged on an outer side of the developing roller with respect to a direction of the developing roller axis;

wherein the toner conveyor is configured to convey and supply the toner entering from the toner input portion to the toner feed portion, along the direction of the developing roller axis; and wherein the toner conveyor comprises a screw element or a plurality of agitating plates tilted in a toner conveying direction;

wherein the toner feed device and the developing unit are connected by a toner input passage part, wherein the toner input passage part is provided with a toner passage formed approximately linearly and configured whereby toner is supplied from the toner input passage part to the developing unit at a position, relative to the developing roller axis, which is outside a width of the transfer belt; and wherein said toner passage is provided with rollers to advance the toner.

* * * * *